US010508381B2

(12) United States Patent
Jung et al.

(10) Patent No.: US 10,508,381 B2
(45) Date of Patent: Dec. 17, 2019

(54) DETERGENT FEEDING DEVICE FOR WASHER

(71) Applicant: LG ELECTRONICS INC., Seoul (KR)

(72) Inventors: Sungwoon Jung, Seoul (KR); Michael Geier, Seoul (KR); Hartmut Hofmann, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 15/321,344

(22) PCT Filed: Jun. 23, 2015

(86) PCT No.: PCT/KR2015/006374
§ 371 (c)(1),
(2) Date: Dec. 22, 2016

(87) PCT Pub. No.: WO2015/199417
PCT Pub. Date: Dec. 30, 2015

(65) Prior Publication Data

US 2017/0159227 A1 Jun. 8, 2017

(30) Foreign Application Priority Data

Jun. 23, 2014 (KR) ..... 10-2014-0076213

(51) Int. Cl.
*D06F 39/02* (2006.01)
*D06F 23/02* (2006.01)
*D06F 39/00* (2006.01)

(52) U.S. Cl.
CPC ..... *D06F 39/022* (2013.01); *D06F 23/02* (2013.01); *D06F 39/005* (2013.01)

(58) Field of Classification Search
CPC ..... D06F 39/022; D06F 39/005; D06F 23/02
See application file for complete search history.

(56) References Cited

U.S. PATENT DOCUMENTS 4,103,520 A * 8/1978 Jarvis ..... D06F 33/02 68/12.18
5,056,542 A * 10/1991 Reinhard ..... A47L 15/0055 134/57 D (Continued)

FOREIGN PATENT DOCUMENTS

CN 101173475 A 5/2008
CN 101440566 A 5/2009

(Continued)

OTHER PUBLICATIONS

Machine Translation of EP 2377988 to Behr et al., Apr. 2011 (Year: 2011).*

(Continued)

*Primary Examiner* — Benjamin L Osterhout
(74) *Attorney, Agent, or Firm* — Fish & Richardson P.C.

(57) ABSTRACT

Provided is a detergent feeding device including a detergent box provided with a detergent accommodating part having an opening part; an opening and closing member; a detergent box housing accommodating the detergent box; a dispenser to supply water to the detergent box; a first water supply tube supplying water to the dispenser; a second water supply tube connected to the detergent box housing; and an opening unit connected to an outlet of the second water supply tube, wherein the opening unit is moved by water pressure of the water supplied from the second water supply tube to push the opening and closing member to open the opening part of the detergent accommodating part.

7 Claims, 5 Drawing Sheets

(56) References Cited

U.S. PATENT DOCUMENTS 5,063,757 A * 11/1991 Ikeda ..... D06F 39/026 222/236
5,860,301 A 1/1999 Song
2002/0100771 A1* 8/2002 Redman ..... A47K 5/12 222/255
2002/0148853 A1* 10/2002 Gauthier ..... A47K 5/1211 222/95
2004/0172770 A1* 9/2004 Heo ..... D06F 39/02 8/158
2005/0235704 A1* 10/2005 Cho ..... D06F 39/02 68/112
2006/0081016 A1* 4/2006 Hsu ..... D06F 39/022 68/12.18
2006/0107705 A1* 5/2006 Hsu ..... D06F 33/02 68/17 R
2007/0044820 A1* 3/2007 Chan ..... A47L 15/4418 134/18
2008/0235880 A1* 10/2008 Kim ..... D06F 39/022 8/137
2009/0100881 A1* 4/2009 Dahlke ..... D06F 39/022 68/17 R
2011/0283747 A1 11/2011 Doh
2012/0070352 A1* 3/2012 Eglmeier ..... D06F 35/001 423/219
2013/0092704 A1* 4/2013 Tincher ..... A47L 15/4418 222/1

FOREIGN PATENT DOCUMENTS

| | | | |
|---|---|---|---|
| DE | 102010016411 | A | 10/2011 |
| EP | 0727520 | | 8/1996 |
| EP | 1607508 | | 12/2005 |
| EP | 2374925 | | 10/2011 |
| EP | 2377988 | | 10/2011 |
| GB | 2317620 | A | 4/1998 |
| KR | 20-1994-0026864 | | 12/1994 |
| KR | 20-0181143 | | 5/2000 |
| KR | 10-1022224 | | 3/2011 |

OTHER PUBLICATIONS

Chinese Office Action in Chinese Application No. 201580025612.9, dated Mar. 13, 2018, 12 pages.
Extended European Search Report in European Application No. 15811952.9, dated Oct. 20, 2017, 8 pages (with English translation).
International Search Report and Written Opinion in International Application No. PCT/KR2015/006374, dated Aug. 31, 2015, 8 pages.

* cited by examiner

【Figure 1】
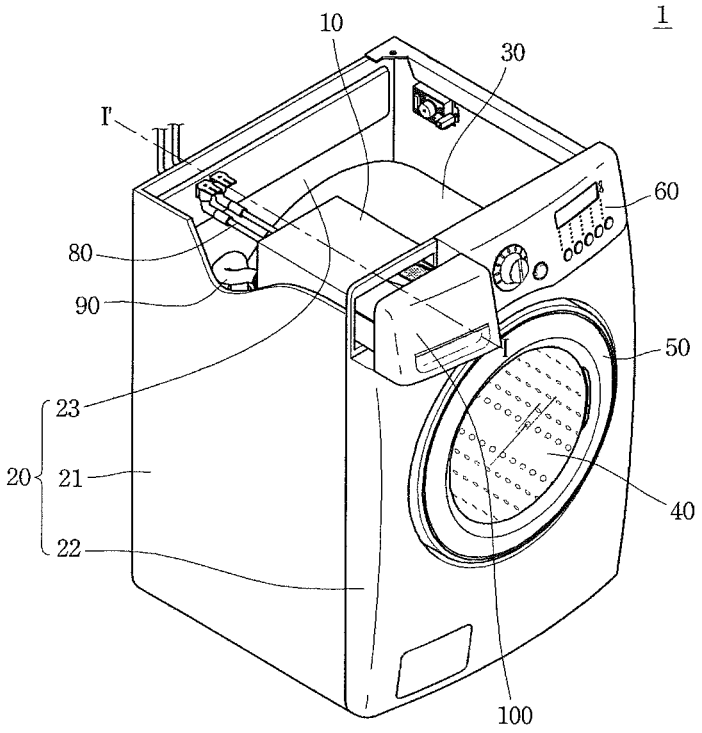
【Figure 2】
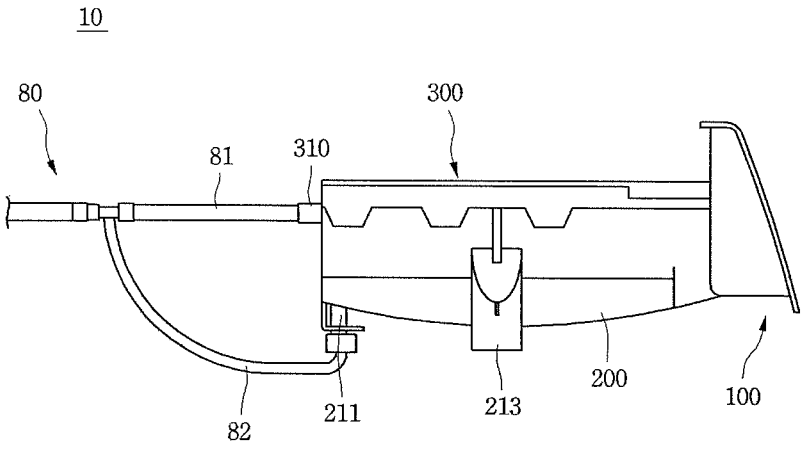

【Figure 3】
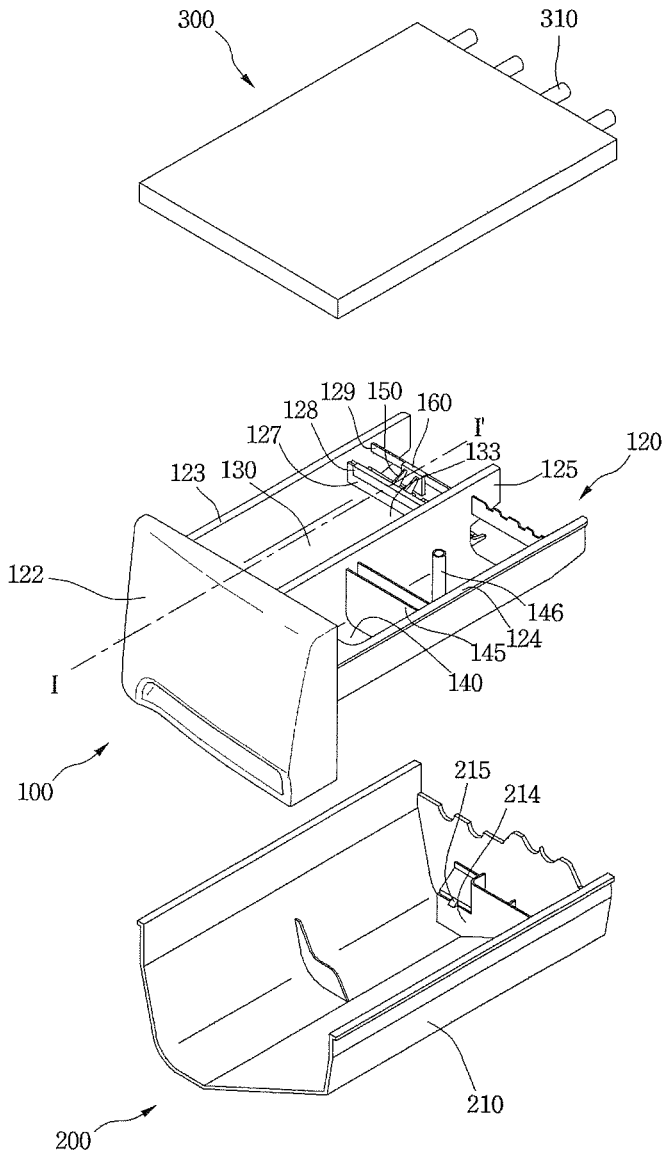

【Figure 4】
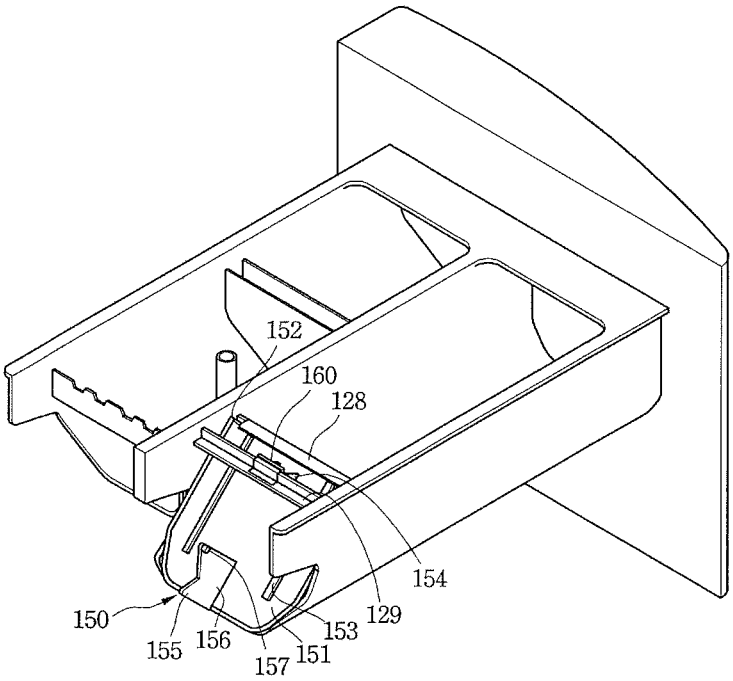
【Figure 5】
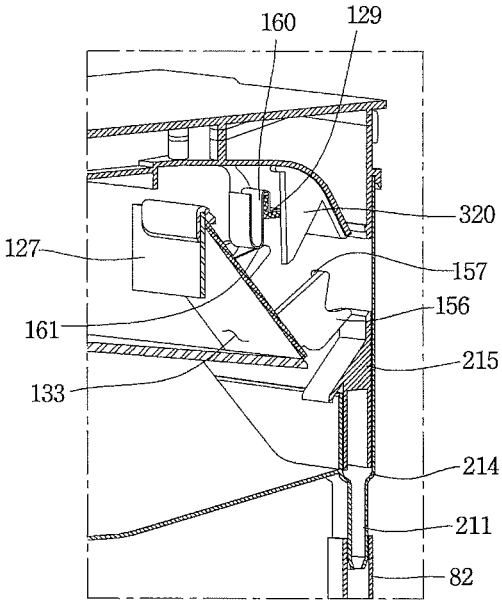

【Figure 6】
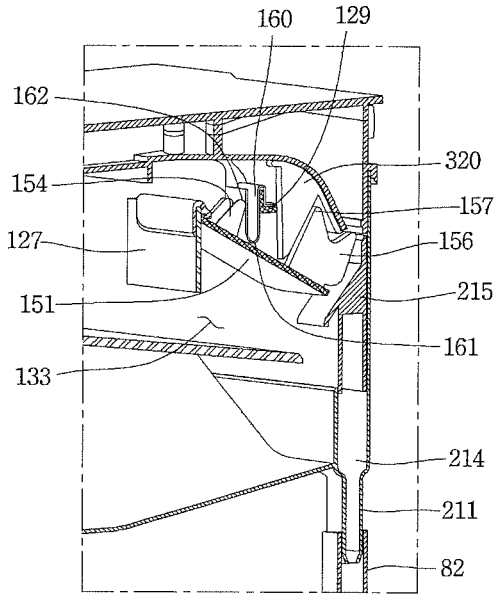
【Figure 7】
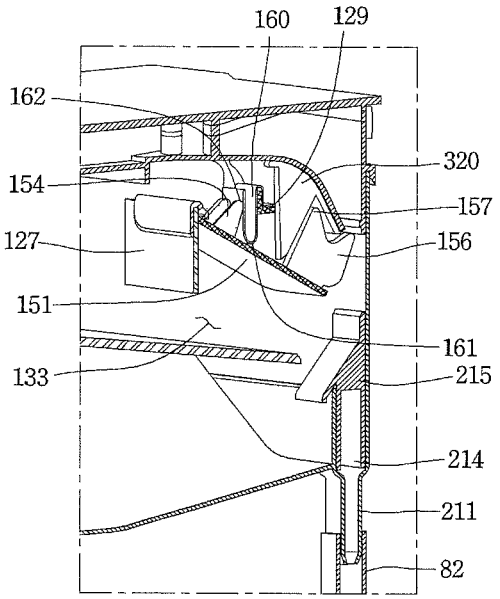

【Figure 8】
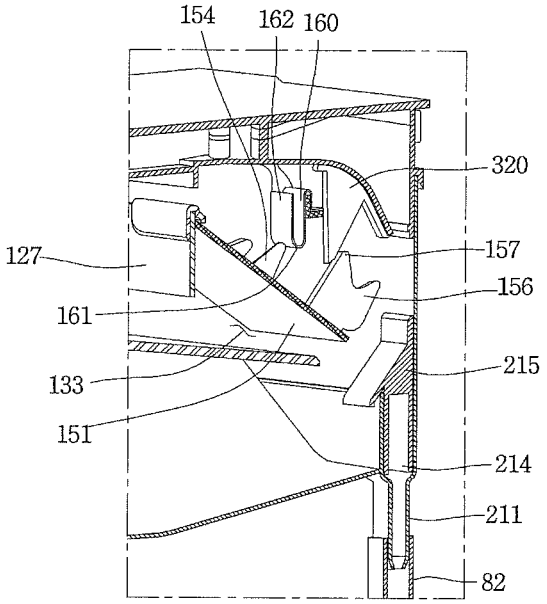
【Figure 9】
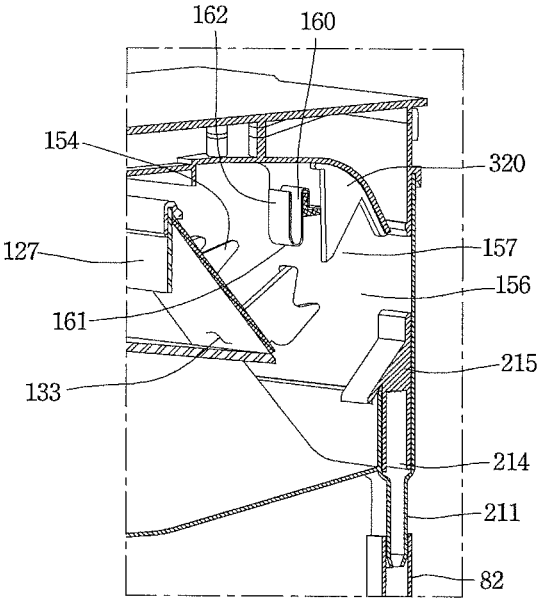

DETERGENT FEEDING DEVICE FOR WASHER

CROSS REFERENCE TO RELATED APPLICATIONS

This application is a U.S. National Phase Application under 35 U.S.C. § 371 of International Application PCT/KR2015/006374, filed on Jun. 23, 2015, which claims the benefit of Korean Application No. 10-2014-0076213, filed on Jun. 23, 2014, the entire contents of which are hereby incorporated by reference in their entireties.

TECHNICAL FIELD

Embodiments of the present disclosure relate to a detergent feeding device for a washer.

BACKGROUND ART

Washers use electric power to wash laundry and may include a tub that stores water, a drum rotatably installed in the tub, and a motor for rotating the drum.

Drum washers, which are widely used, include a drum that rotates to move laundry up and down. The laundry drops together with water to collide with the water, and the collision and a surfactant action of a detergent remove impurities from the laundry.

Such a drum washer includes a detergent feeding device that is installed above the drum to supply a detergent to the drum. The detergent feeding device includes a detergent accommodating part accommodating a powder detergent and a liquid detergent, and a water supply unit that supplies water to the detergent accommodating part. The detergent feeding device is connected to the drum through a bellows.

When a user feeds a powder detergent into the detergent accommodating part, the powder detergent stays in the detergent accommodating part. When water is supplied, the powder detergent is washed down to an outflow hole of the detergent feeding device by the supplied water and is uniformly mixed with the supplied water. In this state, the powder detergent is supplied into the drum through the bellows.

As such, when a user feeds a powder detergent into a detergent accommodating part of a detergent feeding device in the related art, the powder detergent can be uniformly mixed with supplied water in the detergent accommodating part. However, when a liquid detergent is fed into the detergent accommodating part, the liquid detergent instantly flows down to an opening part along an inclined bottom of the detergent accommodating part and is supplied to a drum. Thus, the liquid detergent cannot be uniformly mixed with supplied water.

In addition, when the liquid detergent is fed into the detergent accommodating part, and simultaneously, flows down to the opening part, it is difficult for the user to check an amount of the fed liquid detergent.

DISCLOSURE

Technical Problem

Embodiments provide a detergent feeding device for a washer, which makes it possible to uniformly mix water with a liquid detergent fed into the detergent feeding device and makes it possible for a user to check an amount of the fed liquid detergent with the naked eyes.

Technical Solution

In one embodiment, a detergent feeding device includes: a detergent box including a detergent accommodating part into which a liquid detergent or a powder detergent is fed, the detergent accommodating part having an opening part; an opening and closing member movably provided at the detergent box to selectively open and close the opening part of the detergent accommodating part; a detergent box housing accommodating the detergent box; a dispenser disposed above the detergent box housing to supply water to the detergent box; a first water supply tube connected to the dispenser and supplying water to the dispenser; a second water supply tube connected to the detergent box housing; and an opening unit provided on the detergent box housing and connected to an outlet of the second water supply tube, wherein the opening unit is moved by water pressure of the water supplied from the second water supply tube to push the opening and closing member to open the opening part of the detergent accommodating part.

The opening unit may comprises a cylinder to receive the water from the second water supply tube, and a piston accommodated in the cylinder, wherein the piston advances by the water pressure of the water supplied from the second water supply tube to push the opening and closing member to open the opening part of the detergent accommodating part.

When the supply of the water to the second water supply tube is stopped, the piston returns to an original position thereof by the weight thereof.

The detergent feeding device may further comprising a fixing rib protruding from the opening and closing member, a support rib to connect a side wall part of the detergent box to a partition side wall part of the detergent box, and an elastic member installed on the support rib and elastically deformed by the fixing rib.

When the opening and closing member is moved by the piston in a first direction, the fixing rib is caught by the elastic member to fix the opening and closing member.

When the detergent box is withdrawn from the detergent box housing, the opening and closing member returns to an original position thereof.

The detergent feeding device may further comprising a guide part protruding from the dispenser to the detergent box, and an auxiliary rib protruding from the opening and closing member to selectively contact the guide part, wherein the auxiliary rib is moved along the guide part to move the opening and closing member to close the opening part of the detergent accommodating part when the detergent box is withdrawn from the detergent box housing.

When the opening and closing member close the opening part of the detergent accommodating part, the fixing rib is caught by the elastic member, so that the opening and closing member maintains the closing of the opening part of the detergent accommodating part.

The details of one or more embodiments are set forth in the accompanying drawings and the description below. Other features will be apparent from the description and drawings, and from the claims.

Advantageous Effects

According to an embodiment, when a liquid detergent is fed into a detergent accommodating part, an opening part of the detergent accommodating part is opened and closed without using separately consuming power, so that the liquid detergent fed into the detergent accommodating part can be uniformly mixed with supplied water and be then fed into a drum, thus improving laundry efficiency.

In addition, when a user feeds a liquid detergent into the detergent accommodating part, the liquid detergent is prevented from instantly flowing down to the opening part, so that the user can check an amount of the fed liquid detergent.

DESCRIPTION OF DRAWINGS

FIG. 1 is a perspective view illustrating a drum washer including a detergent feeding device according to an embodiment.

FIG. 2 is a view illustrating a connection relationship between a detergent feeding device and a water supply tube according to an embodiment.

FIG. 3 is an exploded perspective view illustrating a detergent feeding device according to an embodiment.

FIG. 4 is a perspective view illustrating a rear part of a detergent box according to an embodiment.

FIGS. 5 and 6 are vertical cross-sectional views taken along line I-I' of FIG. 1, which illustrate a state that a piston raises an opening and closing member to open an opening part.

FIGS. 7 to 9 are vertical cross-sectional views taken along line I-I' of FIG. 1, which illustrate a state that an opening part is closed by an opening and closing member when a detergent box is withdrawn from a dispenser cover.

MODE FOR INVENTION

Hereinafter, exemplary embodiments will be described with reference to the accompanying drawings such that those skilled in the art realize the present disclosure without difficulty. However, detailed descriptions related to well-known functions or configurations will be ruled out in order not to unnecessarily obscure subject matters of the present disclosure. Like reference numerals denote like elements throughout.

The accompanying drawings are exemplary drawings used to describe the exemplary embodiments of the present disclosure, and thus, the technical scope of the present disclosure is not limited thereto. In addition, the size and shape of each element in the drawings may be exaggerated for convenience in description.

It will be understood that although the terms of first and second are used herein to describe various elements, these elements should not be limited by these terms that are only used to distinguish one element from other elements.

Throughout the present disclosure, when one part is referred to as being "connected" to another part, it should be understood that the former can be "directly connected" to the latter or be "indirectly connected" to the latter via an intervening part. In addition, when it is described that one "comprises (or includes or has)" certain elements, it should be understood that it may comprise (or include or has) only those elements, or it may comprise (or include or have) other elements as well as those elements if there is no specific limitation.

FIG. 1 is a perspective view illustrating a drum washer provided with a detergent feeding device according to an embodiment.

Referring to FIG. 1, a drum washer 1 provided with a detergent feeding device 10 according to the current embodiment includes a side cover 21, a cabinet 20, a tub 30 installed in the cabinet 20, a drum 40, a door 50, a control panel 60, a water supply unit 80, and a bellows 90.

The detergent feeding device 10 is installed above the tub 30. The detergent feeding device 10 may be provided with a detergent box 100.

The cabinet 20 may be constituted by a back cover 23 and a front cover 22 and protect an inner part of the drum washer 1.

The drum 40 may be accommodated in the tub 30, and laundry may be fed into the drum 40.

The door 50 may be installed in a central part of the front cover 22 and open and close a front surface of the drum 40.

The control panel 60 may be installed on an upper side of the front cover 22, and a command for controlling an operation of the drum washer 1 may be input to the control panel 60.

The water supply unit 80 may be installed on a side of the back cover 23 to supply water to the detergent feeding device 10.

The bellows 90 may connect the detergent feeding device 10 to the tub 30.

An operation process of the drum washer 1 will now be described.

A user may open the door (50) and feed laundry into the drum 40, and then, input a washing condition using a manipulation device installed on the control panel 60. Next, when the user presses a start button, water is supplied through the water supply unit 80 to the detergent feeding device 10. Then, the water and a detergent are mixed in the detergent feeding device 10, and the water mixed with the detergent is introduced through the bellows 90 into the tub 30 and the drum 40. When the water reaches a set water level in the drum 40, a supply of water is stopped, and the drum 40 rotates to start a washing operation.

FIG. 2 is a view illustrating a connection relationship between a detergent feeding device and a water supply tube according to an embodiment. FIG. 3 is an exploded perspective vie illustrating a detergent feeding device including a detergent box according to an embodiment.

Referring to FIGS. 2 and 3, the detergent feeding device 10 includes the detergent box 100, a detergent box housing 200, a dispenser 300, a first water supply tube 81, and a second water supply tube 82 according to an embodiment.

The detergent box 100 may be accommodated in the detergent box housing 200 and be inserted therein such that the detergent box 100 can be withdrawn forward.

The detergent box housing 200 may communicate with the bellows 90.

The dispenser 300 may be disposed above the detergent box housing 200 and supply water to the detergent box 100.

The first water supply tube 81 and the second water supply tube 82 diverge from the water supply unit 80. The first water supply tube 81 and the second water supply tube 82 may be connected to the water supply unit 80 through a Y-connector.

An outlet end of the first water supply tube 81 is connected to the dispenser 300. Accordingly, a portion of water supplied from the outside may be supplied to the dispenser 300 through the first water supply tube 81.

An outlet end of the second water supply tube 82 is connected to a side of the detergent box housing 200. Accordingly, a portion of the water supplied from the outside may be supplied to the detergent box housing 200 through the second water supply tube 82.

The detergent box housing 200 includes a housing main body 210, a drain 213 disposed in a lower part of an outer circumferential surface of the housing main body 210, a second inflow port 211 protruding from the outer circumferential surface of the housing main body 210 and connected to the outlet end of the second water supply tube 82, a cylinder 214 extending into the housing main body 210 and connected to the second inflow port 211, and a piston 215 accommodated in the cylinder 214 and reciprocating.

The drain 213 may be formed into a pipe shape in a direction to the underside of the detergent box housing 200. The drain 213 is connected to the bellows 90. Accordingly, water and a detergent mixed in the detergent box 100 may be moved to the bellows 90 via the drain 213.

When water supplied from the second water supply tube 82 is moved to the second inflow port 211, water pressure may be formed in the cylinder 214. Accordingly, the piston 215 may be moved upward.

The detergent box 100 may include a detergent box main body 120 and a front panel 122 installed on a front part of the detergent box main body 120 and having a handle on a side thereof.

The detergent box main body 120 is formed into a box shape having an open upper surface and an open rear surface, and a partition side wall part 125 is elongated in the longitudinal direction of the detergent box main body 120 between wall parts 123 and 124 at a side of the detergent box main body 120.

The detergent box main body 120 may be provided with a first detergent accommodating part 130.

The first detergent accommodating part 130 may be elongated between the partition side wall part 125 and the side wall part 123, as a right wall part, in the longitudinal direction thereof. A rear end of the first detergent accommodating part 130 may be open. In addition, a liquid detergent or a powder detergent may be fed into the first detergent accommodating part 130.

The detergent box main body 120 may be provided with a second detergent accommodating part 140.

The second detergent accommodating part 140 may be elongated between the partition side wall part 125 and the side wall part 124, as a left wall part, in the longitudinal direction thereof. A rear end of the second detergent accommodating part 140 may be open. In addition, a softening agent or a bleaching agent may be fed into the second detergent accommodating part 140. The first detergent accommodating part 130 and the second detergent accommodating part 140 may be collectively called "a detergent accommodating part".

The first detergent accommodating part 130 may be provided with a first support rib 127 formed in a position spaced a predetermined distance rearward from the front panel 122, and a second support rib 129 on which an elastic member 160 is installed. The first support rib 127 and the second support rib 129 may be collectively called "a support rib".

The first detergent accommodating part 130 may be provided with an opening part 133 at a rear end part thereof, and an opening and closing member 150 movably provided in the first detergent accommodating part 130 to selectively open and close the opening part 133.

The opening and closing member 150 may be hinged to the first support rib 127. The opening and closing member 150 will be described later in detail with reference to FIG. 4.

The first support rib 127 is a plate type member, both side ends of which are connected to the partition side wall part 125 and the right wall part 123, respectively, and may be spaced a predetermined distance from a bottom surface of the first detergent accommodating part 130 to form a passage through which a detergent is discharged to the detergent box housing 200.

The first support rib 127 may include a pivot body 128 hinged to the opening and closing member 150.

The first support rib 127 may prevent a lump of powder detergent from falling to the detergent box housing 200 and set a volume of detergent to be accommodated in the first detergent accommodating part 130.

The opening part 133 defines a space formed between the first support rib 127 and the bottom surface of the first detergent accommodating part 130 and functions as a passage through which a detergent and water mixed in the first detergent accommodating part 130 are discharged to the detergent box housing 200.

The second detergent accommodating part 140 is provided with a detergent amount set rib 145, both side ends of which are connected to the partition side wall part 125 and the left wall part 124, respectively, and a siphon pipe 146 protruding upward from a lower surface of the second detergent accommodating part 140.

The dispenser 300 includes a first inflow port 310 provided on a rear part of the dispenser 300 and connected to the first water supply tube 81 diverging from the water supply unit 80, and a water supply passage (not shown) provided on a lower surface of the dispenser 300.

water supplied from the water supply unit 80 is introduced into the dispenser 300 via the first water supply tube 81 and is supplied to the detergent box 100 through the water supply passage.

The dispenser 300 further includes a guide part 320 on the lower surface thereof, which will be described later (refer to FIGS. 7 to 9). A function of the guide part 320 will be described later with reference to FIGS. 7 to 9.

FIG. 4 is a perspective view illustrating a rear part of a detergent box according to an embodiment.

Referring to FIG. 4, the opening and closing member 150 may include a body part 151 that opens and closes the opening part 133 of the first detergent accommodating part 130, a fixing rib 154 formed on the body part 151 and contacting the elastic member 160 provided on the second support rib 129, a packing part 155 disposed on a border of the body part 151, an auxiliary rib 156 provided on the body part 151, and a protrusion part 157 protruding from a side surface of the auxiliary rib 156.

The opening and closing member 150 may further include a joining part 152 that is formed at a side of the body part 151 to hinge the body part 151 to the first support rib 127.

The joining part 152 may be hinged to the pivot body 128, and the opening and closing member 150 is rotatable about a hinge shaft of the joining part 152 so as to selectively open and close the rear end of the first detergent accommodating part 130.

However, methods of opening and closing the rear end of the first detergent accommodating part 130 using the opening and closing member 150 are not limited to the rotating of the opening and closing member 150 about the hinge shaft. Thus, the opening and closing member 150 may be slid to open and close the rear end of the first detergent accommodating part 130.

When the opening and closing member 150 opens or closes the opening part 133, the fixing rib 154 contacts the elastic member 160. At this point, the elastic member 160 is elastically deformed by the fixing rib 154. At this point, the fixing rib 154 receives elastic force, generated by the elastic deformation of the elastic member 160, to fix the body part 151. A positional relationship between the fixing rib 154 and the elastic member 160 will be described in detail with reference to FIGS. 5 to 9.

The packing part 155 maintains air-tightness between the body part 151 and the first detergent accommodating part 130. That is, when the opening and closing member 150 closes the opening part 133, the packing part 155 prevents a liquid detergent or water, fed into the first detergent accommodating part 130, from leaking to the opening part 133.

When the opening and closing member 150 opens or closes the opening part 133, the auxiliary rib 156 and the protrusion part 157 perform an auxiliary function, and a detailed operational principle thereof will be described later with reference to FIGS. 5 to 9.

The opening and closing member 150 may further include a reinforcing rib 153 formed on a surface of the body part 151 and increasing impact strength of the body part 151.

FIGS. 5 and 6 are vertical cross-sectional views taken along line I-I' of FIG. 1, which illustrate a state that a piston raises an opening and closing member to open an opening part. Specifically, FIG. 5 illustrates a state that the opening part is closed by the opening and closing member, and FIG. 6 illustrates a state that the opening part is opened.

Referring to FIGS. 5 and 6, when the opening part 133 is closed, the fixing rib 154 contacts a lower surface part 161 of the elastic member 160. At this point, elastic force of the elastic member 160 is applied downward to the fixing rib 154. The magnitude of force of the elastic member 160 applied to the fixing rib 154 may be adjusted based on a material for the elastic member 160 and a shape thereof. Accordingly, even when a liquid detergent or water is accommodated in the first detergent accommodating part 130, the opening and closing member 150 is prevented from being opened.

Thus, when a user feeds a liquid detergent into the first detergent accommodating part 130, the liquid detergent does not flow to the opening part 133 and stays in the first detergent accommodating part 130 by the opening and closing member 150.

When the user feeds the liquid detergent into the first detergent accommodating part 130 and then operates the drum washer 1, water is supplied from the water supply unit 80 through the dispenser 300 to the first detergent accommodating part 130.

The water is supplied to the first detergent accommodating part 130 through the first water supply tube 81 diverging from the water supply unit 80 and simultaneously, is supplied to the second water supply tube 82 diverging from the water supply unit 80. At this point, the water may flow through the second inflow port 211 to the cylinder 214. As the water is introduced into the second water supply tube 82, water pressure is applied to the inside of the cylinder 214, whereby the piston 215 advances.

While the piston 215 advances, the piston 215 pushes the auxiliary rib 156 upward to a side thereof. Accordingly, the opening and closing member 150 moves to the side of the auxiliary rib 156 so as to open the opening part 133. At this point, the opening and closing member 150 may rotate about the hinge shaft of the joining part 152.

As the opening part 133 is opened, the liquid detergent stored in the first detergent accommodating part 130 is mixed with the water supplied from the first water supply tube 81 and is sequentially passed through the drain 213 of the detergent box housing 200 and the bellows 90 via the opening part 133 and is then introduced into the tub 30 and the drum 40.

The second inflow port 211, the cylinder 214, and the piston 215 may be collectively called "an opening unit".

According to another embodiment, the piston 215 may directly push the body part 151 upward, instead of pushing the auxiliary rib 156.

When the body part 151 of the opening and closing member 150 is moved to the side of the auxiliary rib 156, the fixing rib 154 is moved along an outer surface of the elastic member 160 and is caught by an upper part 162 of the elastic member 160, so as to fix the opening and closing member 150 moved to the side of the auxiliary rib 156.

Thus, even when the supply of the water is stopped to remove inner pressure of the cylinder 214 and return the piston 215 to an original position thereof, the opening and closing member 150 is maintained in the state of being fixed to the elastic member 160, and thus, the opening of the opening part 133 is maintained.

FIGS. 7 to 9 are vertical cross-sectional views taken along line I-I' of FIG. 1, which illustrate a state that an opening part is closed by an opening and closing member when a detergent box is withdrawn from a dispenser. Specifically, FIG. 7 illustrates a state that the opening part is fully opened, and FIG. 9 illustrates a state that the opening part is fully closed, and FIG. 8 illustrates a state between the states of FIGS. 7 and 9.

Referring to FIGS. 7 to 9, the guide part 320 protrudes from the lower surface of the dispenser 300 to the detergent box 100, and the opening and closing member 150 is fixed to an upper region by the elastic member 160, so that the protrusion part 157 contacts the guide part 320. The guide part 320 may have a triangular plate shape as shown in the drawings, but is not limited thereto.

When the user pulls the detergent box 100 out of the detergent box housing 200, the protrusion part 157 is moved downward along the guide part 320. Accordingly, the opening and closing member 150 rotates to an original position thereof about the hinge shaft, so that the body part 151 closes the opening part 133.

When the protrusion part 157 moves downward along the guide part 320 to move the opening and closing member 150 to the original position thereof, the fixing rib 154 is moved along the outer surface of the elastic member 160.

When the opening and closing member 150 is moved to the original position thereof to close the rear end of the detergent accommodating part, the fixing rib 154 is caught by the lower surface part 161 of the elastic member 160, so that the opening and closing member 150 maintains the closing of the rear end of the detergent accommodating part.

According to another embodiment, the opening and closing member 150 may be moved to the original position thereof by bringing the auxiliary rib 156 into direct contact with the guide part 320.

Thus, while the detergent box 100 is withdrawn outward without a separate operation, the opening and closing member 150 closes the opening part 133 again. Accordingly, the liquid detergent stays in the first detergent accommodating part 130 until the water is introduced into the first detergent accommodating part 130.

According to another embodiment, the opening and closing member 150 and the elastic member 160 may be provided on the second detergent accommodating part 140, instead of being on the first detergent accommodating part 130.

According to an embodiment, when a liquid detergent is fed into a detergent accommodating part, an opening part of the detergent accommodating part is opened and closed without using separately consuming power, so that the liquid detergent fed into the detergent accommodating part can be uniformly mixed with supplied water and be then fed into a drum, thus improving laundry efficiency.

In addition, when the liquid detergent is fed into the detergent accommodating part, and simultaneously, flows down to the opening part, a user can check an amount of the fed liquid detergent.

Although exemplary embodiments have been described, the present disclosure is not limited thereto. In addition, it will be understood by those skilled in the art that various changes in form and details may be made therein without departing from the spirit and scope of the present disclosure. For example, each element specified in the embodiments may be modified. Furthermore, different features related to such modifications and applications should be construed as being included in the scope of the present disclosure as defined by the appended claims.

The invention claimed is:

1. A detergent feeding device comprising:

a detergent box with a detergent accommodating part, the detergent accommodating part being configured to receive a liquid detergent or a powder detergent, and including an opening part at a rear end;

a detergent box housing having wall parts and houses the detergent box;

a dispenser disposed above the detergent box housing and that is configured to supply water to the detergent box;

a support rib that connects wall parts of the detergent box;

an opening and closing member hinged to the supporting rib that is configured to selectively open and close the opening part;

an elastic member mounted to the support rib;

a fixing rib that protrudes from one surface of the opening and closing member and extends to contact the elastic member;

a first water supply tube connected to the dispenser and that is configured to supply water to the dispenser;

a second water supply tube connected to the detergent box housing; and an opening unit provided on the detergent box housing and connected to an outlet of the second water supply tube, wherein the opening unit is configured to be moved by water pressure of the water supplied from the second water supply tube to push the opening and closing member to open the opening part, and wherein the fixing rib is configured to contact the elastic member along movement of the opening unit.

2. The detergent feeding device according to claim 1, wherein the opening unit comprises:

a cylinder that is configured to receive the water from the second water supply tube, and a piston accommodated in the cylinder, wherein the piston is configured to be advanced by the water pressure of the water supplied from the second water supply tube to push the opening and closing member to open the opening part of the detergent accommodating part.

3. The detergent feeding device according to claim 2, wherein when the supply of the water to the second water supply tube is stopped, the piston is configured to return to an original position based on the weight of the piston.

4. The detergent feeding device according to claim 1, wherein, when the opening and closing member is moved by the piston in a first direction, the fixing rib is configured to catch the elastic member to fix the opening and closing member.

5. The detergent feeding device according to claim 4, wherein, when the detergent box is withdrawn from the detergent box housing, the opening and closing member is configured to return to an original position of the opening closing member.

6. The detergent feeding device according to claim 1, further comprising:

a guide part that protrudes from the dispenser towards the detergent box, and an auxiliary rib that protrudes from the opening and closing member to selectively contact the guide part, wherein the auxiliary rib is configured to move along the guide part to move the opening and closing member to close the opening part of the detergent accommodating part when the detergent box is withdrawn from the detergent box housing.

7. The detergent feeding device according to claim 6, wherein, when the opening and closing member close the opening part of the detergent accommodating part, the fixing rib is configured to catch the elastic member, so that the opening and closing member maintains the closing of the opening part of the detergent accommodating part.

* * * * *